US006550512B2

(12) United States Patent
Yang

(10) Patent No.: US 6,550,512 B2
(45) Date of Patent: Apr. 22, 2003

(54) LABELING MACHINE CAPABLE OF PREVENTING ERRONEOUS ATTACHMENT OF LABELS ON CONTAINERS

(76) Inventor: Sheng-Hui Yang, No. 2, Lane 64, Tung-Kuang-Yuan Rd., Tung Dist., Taichung City (TW)

( * ) Notice: Subject to any disclaimer, the term of this patent is extended or adjusted under 35 U.S.C. 154(b) by 0 days.

(21) Appl. No.: 09/767,783

(22) Filed: Jan. 23, 2001

(65) Prior Publication Data

US 2002/0096261 A1 Jul. 25, 2002

(51) Int. Cl.[7] ..... B65C 9/40; B65C 9/42; B65C 9/44

(52) U.S. Cl. ..... 156/351; 156/360; 156/363; 156/540; 156/541

(58) Field of Search ..... 156/350, 351, 156/352, 360, 361, 362, 363, 368, 540, 541, 542, 64, DIG. 44, DIG. 45, DIG. 46

(56) References Cited

U.S. PATENT DOCUMENTS

| | | | | |
|---|---|---|---|---|
| 4,239,570 A | | 12/1980 | Kerwin | |
| 4,294,644 A | * | 10/1981 | Anderson | 156/361 |
| 4,363,693 A | * | 12/1982 | Fujii et al. | 156/360 |
| 4,585,506 A | * | 4/1986 | Matsuguchi | 156/361 |
| 4,620,887 A | | 11/1986 | Kontz et al. | |
| 4,647,333 A | | 3/1987 | Voltmer et al. | |
| 4,835,720 A | * | 5/1989 | Ditto et al. | 702/158 |
| RE33,579 E | * | 4/1991 | Voltmer et al. | 156/361 |
| 5,256,239 A | | 10/1993 | Voltmer et al. | |
| 5,269,864 A | | 12/1993 | Otruba | |
| 5,427,029 A | * | 6/1995 | Dumke | 101/484 |
| 5,730,816 A | * | 3/1998 | Murphy | 156/229 |
| 5,785,798 A | | 7/1998 | Horsman et al. | |
| 5,798,020 A | | 8/1998 | Coughlin et al. | |
| 5,810,955 A | | 9/1998 | Seifert et al. | |

OTHER PUBLICATIONS

Microscan Systems, Inc., 2001, http://www.microscan-.com.*

* cited by examiner

*Primary Examiner*—Richard Crispino
*Assistant Examiner*—Sue A. Purvis
(74) *Attorney, Agent, or Firm*—Harness, Dickey & Pierce, P.L.C.

(57) ABSTRACT

A labeling machine includes a label applying unit disposed adjacent to a conveying unit, and a controller coupled electrically to a bar code sensor, a label sensor and a container sensor. The controller compares bar code data of a label from the bar sensor with predetermined bar code data, and generates an inhibit signal when a mismatch occurs. The controller determines length of the label in accordance with first and second signals from the label sensor and distance information from an encoder unit, compares the determined length with predetermined label length data, and generates the inhibit signal when a mismatch occurs. The controller determines container dimension of a container being conveyed by the conveying unit in accordance with container feature information from the container sensor and distance information from another encoder unit, compares the determined container dimension with predetermined container dimension, and generates the inhibit signal when a mismatch occurs.

5 Claims, 7 Drawing Sheets

LABELING MACHINE CAPABLE OF PREVENTING ERRONEOUS ATTACHMENT OF LABELS ON CONTAINERS

BACKGROUND OF THE INVENTION

1. Field of the Invention

The invention relates to a labeling machine, more particularly to a labeling machine that is capable of preventing erroneous attachment of labels on containers.

2. Description of the Related Art

Commodities, such as beverage bottles, drug bottles, containers, and packaging boxes, are generally provided with a label to classify products, to indicate usage and other information, to display the trademark or logo of the manufacturer, etc. With the recent advancement in automation, automated attachment of labels to such commodities has taken the place of manual label attachment, and has become quite popular in the industry.

In a conventional label attaching process, a reel of labels is arranged on a reel supporting plate. A leading edge of the reel is drawn via a driving device to a label applicator plate where the labels are applied to containers being advanced by a container conveyer.

Since the sizes of containers vary, the sizes and lengths of the labels attached thereto also vary. Although the conventional labeling machine can perform automatic label attaching, inspection of erroneous attachment of labels on containers is done manually. Particularly, when the bar code printed on a label, which was attached to a container, is incorrect, such an erroneous attachment is hard to inspect according to the appearance of the incorrect bar code. If the incorrect label cannot be inspected, many problems may arise. Furthermore, if a label with a specific bar code and length is attached to the wrong container, such as a drug bottle, such an erroneous attachment may result in dire consequences.

SUMMARY OF THE INVENTION

Therefore, the main object of the present invention is to provide a labeling machine capable of preventing erroneous attachment of labels on containers.

According to the present invention, a labeling machine includes a motor-driven container conveying unit, a label applying unit, first and second encoder units, a bar code sensor, a label sensor, a container sensor, and a controller.

The conveying unit has a feed-in end and a take-out end, and is adapted to convey a container from the feed-in end to the take-out end.

The label applying unit is disposed adjacent to the conveying unit between the feed-in and take-out ends, and is operable so as to be adapted to attach a label on the container being conveyed by the conveying unit. The label applying unit includes a reel support plate, a label applicator plate and a motor-driven guide roller unit. The reel support plate is adapted to support a label reel thereon. The label reel includes a backing paper strip and a plurality of the labels releasably and successively adhered on the backing paper strip. Each of the labels has a bar code printed thereon. The label applicator plate is adapted to release one of the labels from the backing paper strip at a label releasing end thereof for application to the container being conveyed by the conveying unit. The guide roller unit is disposed between the reel support plate and the label applicator plate, and is operable so as to feed one end of the label reel on the reel support plate to the label applicator plate.

The first encoder unit is associated with the conveying unit, and is operable so as to generate first distance information to indicate distance advanced by the container due to operation of the conveying unit.

The second encoder unit is associated with the guide roller unit, and is operable so as to generate second distance information to indicate distance advanced by said one end of the label reel during feeding operation of the guide roller unit.

The bar code sensor is disposed adjacent to the reel support plate, and is adapted to sense the bar code on the labels of the label reel and to generate corresponding bar code data.

The label sensor is disposed between the reel support plate and the label applicator plate. The label sensor generates a first signal upon detection of a leading edge of one of the labels on the label reel, and further generates a second signal upon detection of a trailing edge of said one of the labels on the label reel.

The container sensor is disposed adjacent to the conveying unit between the feed-in and take-out ends. The container sensor generates container feature information of the container being conveyed by the conveying unit.

The controller is coupled electrically to the first and second encoder units, the bar code sensor, the label sensor and the container sensor. The controller compares the bar code data from the bar code sensor with predetermined bar code data, and generates an inhibit signal when a mismatch occurs. The controller determines length of one of the labels on the label reel in accordance with the first and second signals from the label sensor and the second distance information from the second encoder unit, compares the determined length with predetermined label length data, and generates the inhibit signal when a mismatch occurs. The controller determines container dimension of the container being conveyed by the conveying unit in accordance with the container feature information from the container sensor and the first distance information from the first encoder unit, compares the determined container dimension with predetermined container dimension, and generates the inhibit signal when a mismatch occurs.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
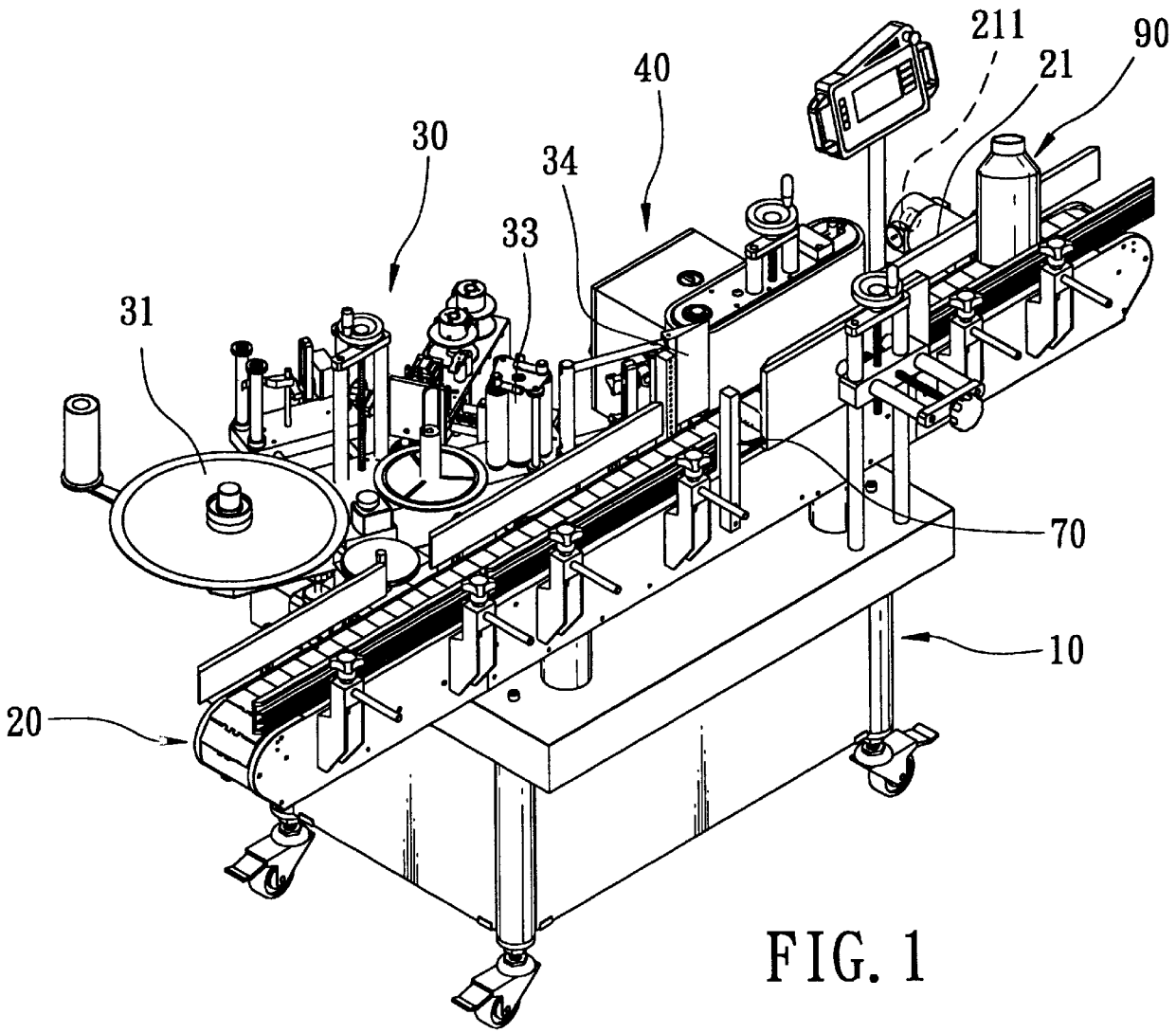
FIG. 1 is a perspective view of the preferred embodiment of a labeling machine according to this invention.

Referring to FIGS. 1 to 4, the preferred embodiment of a labeling machine according to this invention is shown to include a motor-driven container conveying unit 20, a label applying unit 30, first and second encoder units 211, 321, a bar code sensor 50, a label sensor 60, a container sensor 70, a controller 40, and an alarm unit 41.

The conveying unit 20 is of a known type having a feed-in end and a take-out end. The conveying unit 20 is driven by a motor 21, and is adapted to convey a container 50 from the feed-in end to the take-out end.

Figure 2:
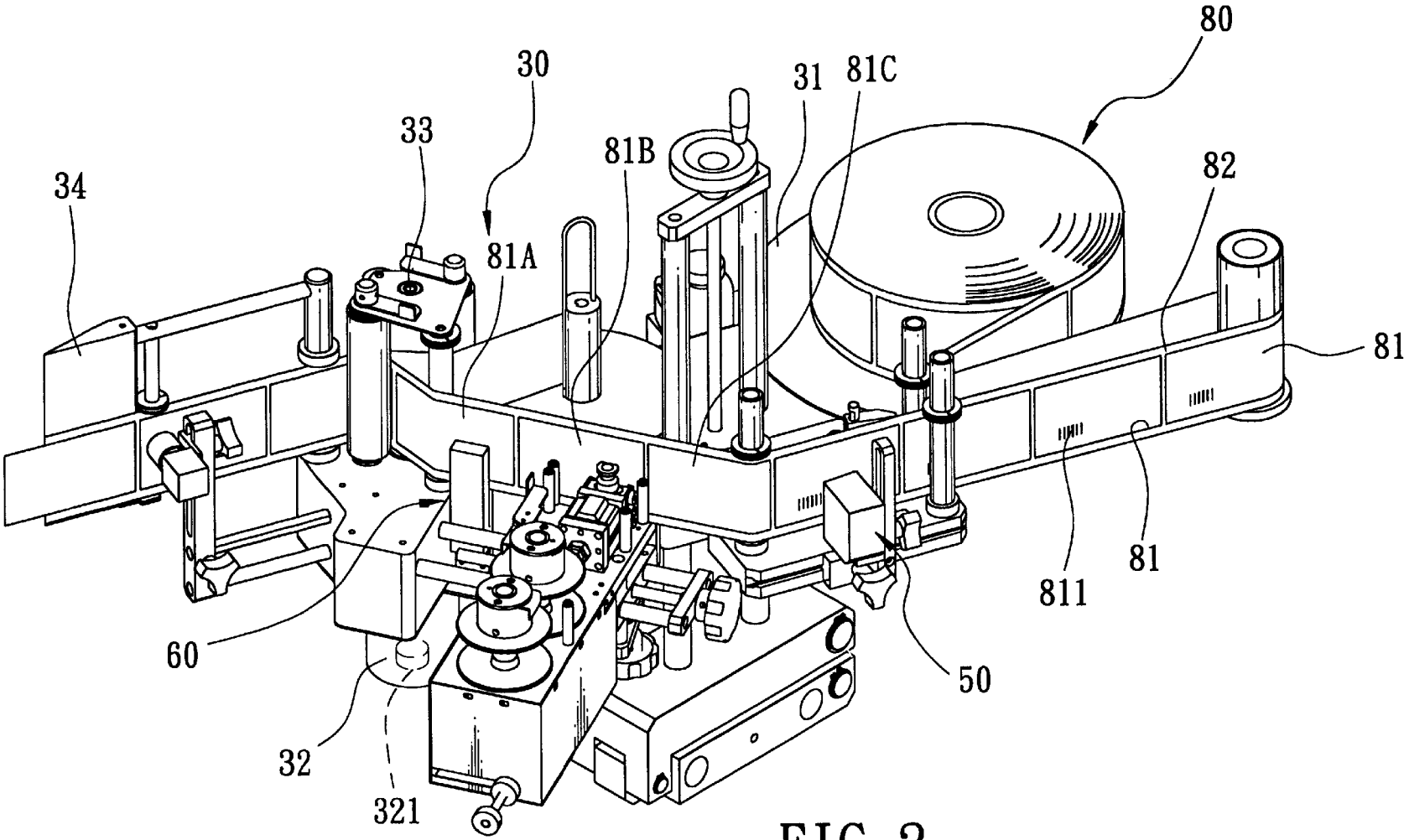
FIG. 2 is a perspective view of a label applying unit of the preferred embodiment.

As shown in FIG. 2, the label applying unit 30 is disposed adjacent to the conveying unit 20 between the feed-in and take-out ends, and is operable so as to be adapted to attach a label 81 on the container 90 being conveyed by the conveying unit 20. The label applying unit includes a reel support plate 31, a label applicator plate 34, and a motor-driven guide roller unit. The reel support plate 31 is adapted to support a label reel 80 thereon. The label reel 80 includes a backing paper strip 82 and a plurality of the labels 81 releasably and successively adhered on the backing paper strip 82. Each of the labels 81 has a bar code printed thereon. The label applicator plate 34 is adapted to release one of the labels 81 from the backing paper strip 82 at a label releasing end thereof for application to the container 90 being conveyed by the conveying unit 20. The guide roller unit is disposed between the reel support plate 31 and the label applicator plate 34, and is operable so as to feed one end of the label reel 80 on the reel support plate 31 to the label applicator plate 34. The guide roller unit includes a drive member 33, and a servo motor 32 for driving the drive member 33. As the label applying unit 30 is known in the art, and since the feature of the invention does not reside in the particular configuration of the same, a detailed description thereof will not be provided herein for the sake of brevity.

The first encoder unit 211 is associated with the conveying unit 20 (in this embodiment, the first encoder unit 211 is coupled to the motor 21), and is operable so as to generate first distance information to indicate distance advanced by the container 90 due to operation of the conveying unit 20.

The second encoder unit 321 is associated with the servo motor 32 of the guide roller unit, and is operable so as to generate second distance information to indicate distance advanced by said one end of the label reel 80 via calculation of the rotational cycle of the servo motor 32 during feeding operation of the guide roller unit.

The bar code sensor 50 is disposed adjacent to the reel support plate 31, and is adapted to sense the bar code 811 on the labels 81 of the label reel 80 and to generate corresponding bar code data.

The label sensor 60 is disposed between the reel support plate 31 and the label applicator plate 34. The label sensor 60 generates a first signal upon detection of a leading edge of one of the labels 81 on the label reel 80, and further generates a second signal upon detection of a trailing edge of said one of the labels 81 on the label reel 80.

Figure 3:
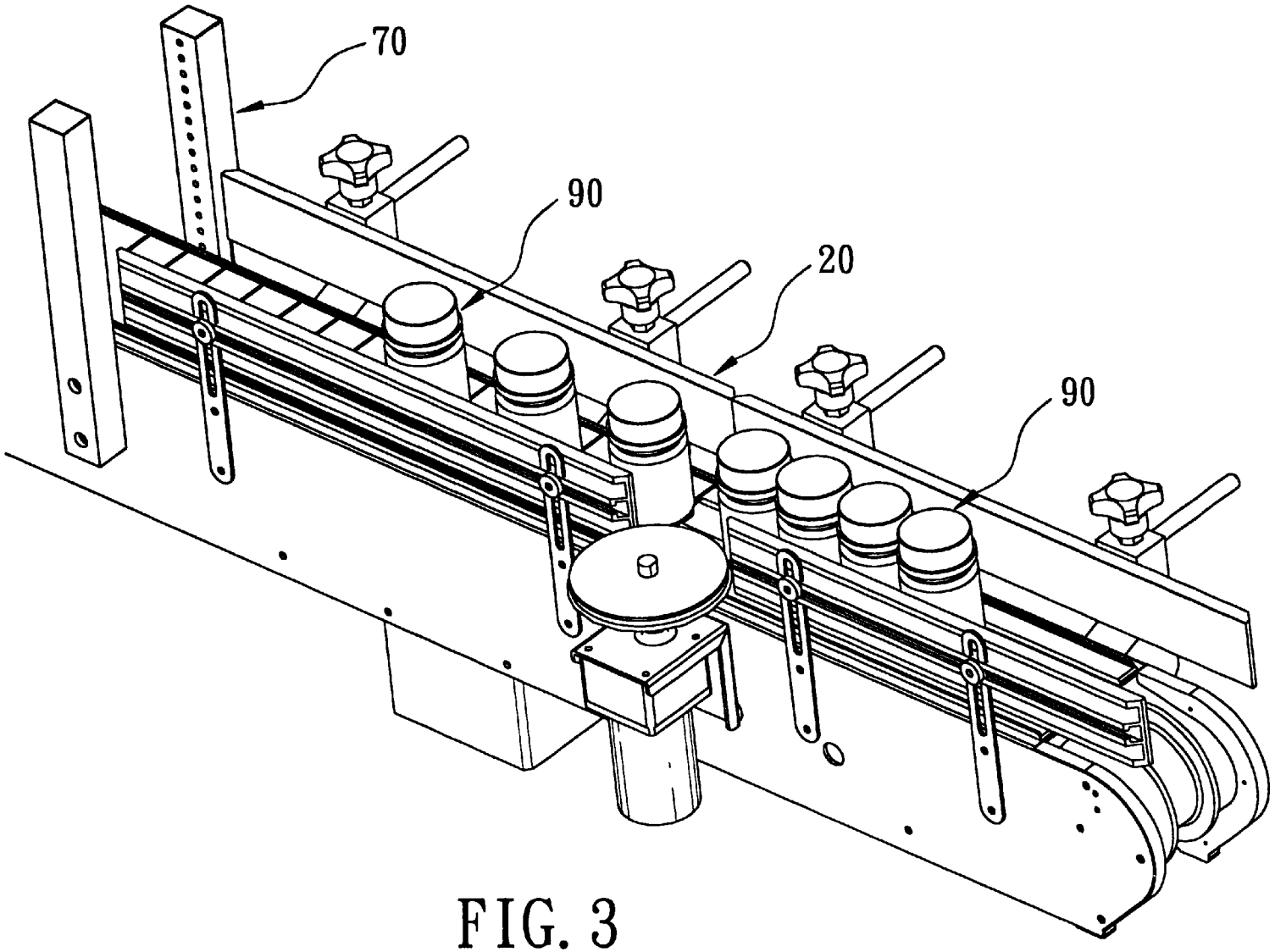
FIG. 3 is a perspective view of a conveying unit and a container sensor of the preferred embodiment.
Figure 4:
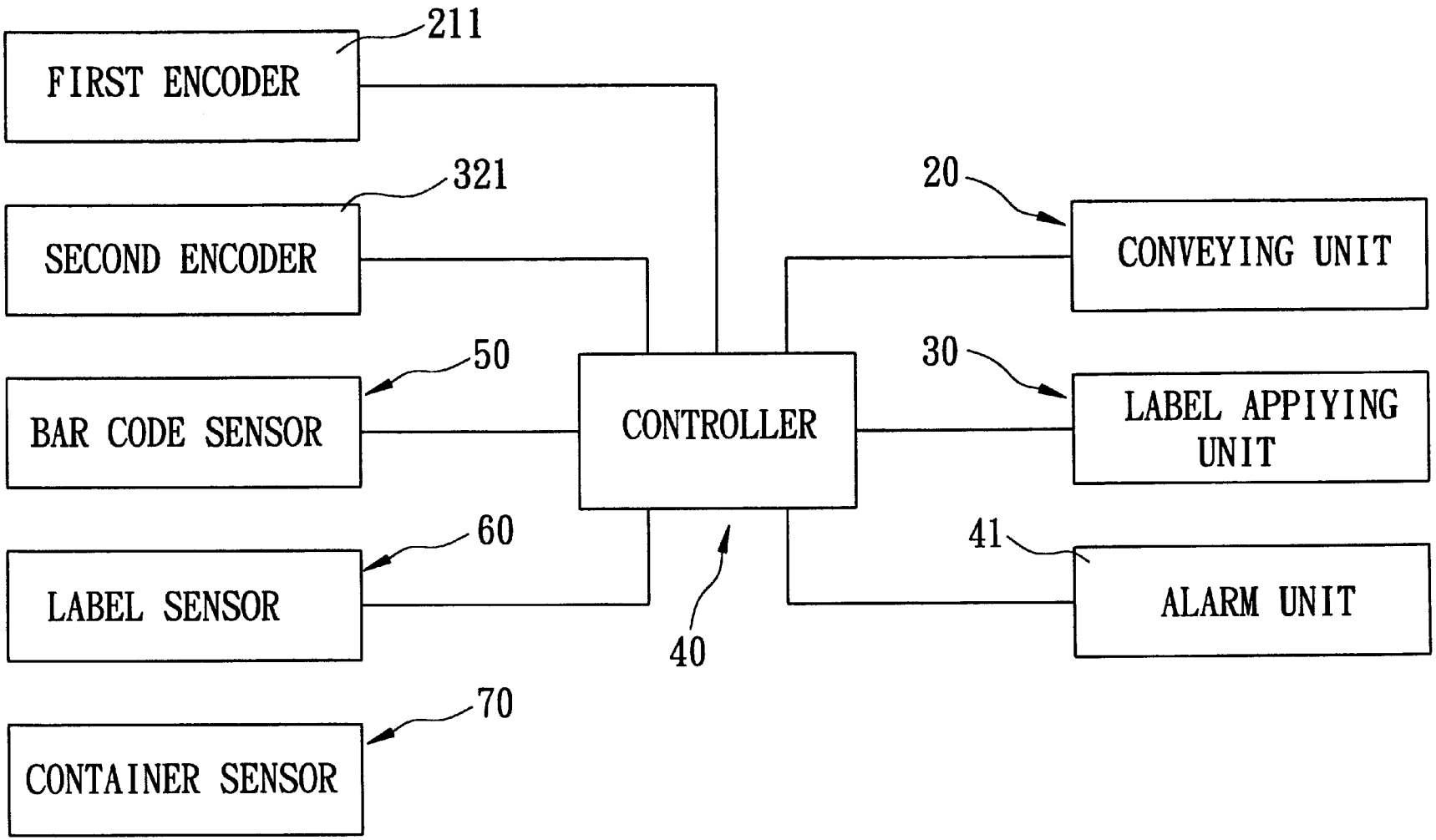
FIG. 4 is a schematic circuit block diagram illustrating the preferred embodiment.

The container sensor 70 is disposed adjacent to the conveying unit 20 between the feed-in and take-out ends (see FIGS. 1 and 3). The container sensor 70 generates container feature information of the container 90 being conveyed by the conveying unit 20. In this embodiment, the container feature information includes a first signal generated by the container sensor 70 upon detection of a leading edge of the container 90 being conveyed by the conveying unit 20, and a second signal generated by the container sensor 70 upon detection of a trailing edge of the container 90 being conveyed by the conveying unit 20.

Figure 5:
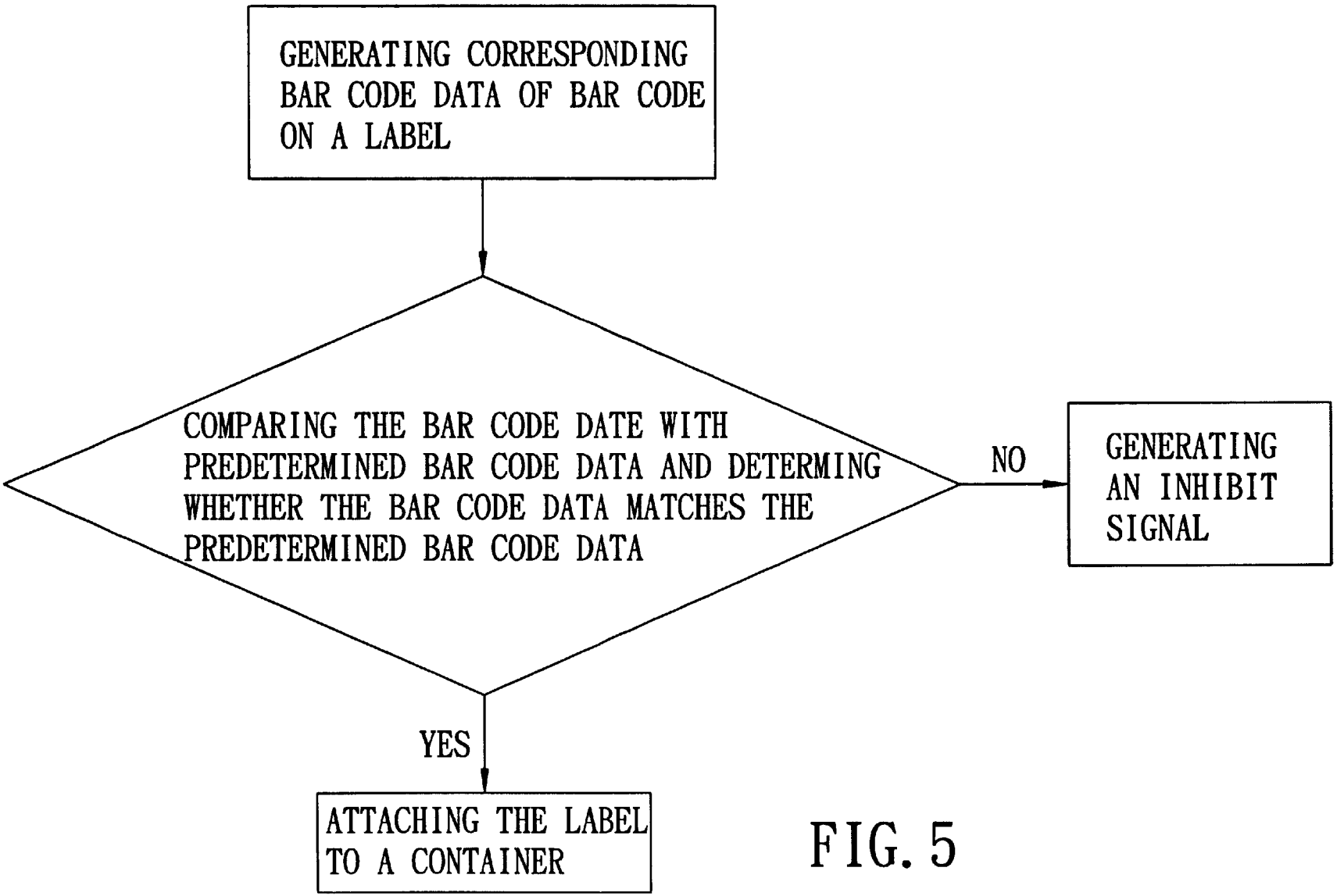
FIG. 5 is a flow chart illustrating a bar code inspecting operation of a controller of the preferred embodiment.
Figure 6:
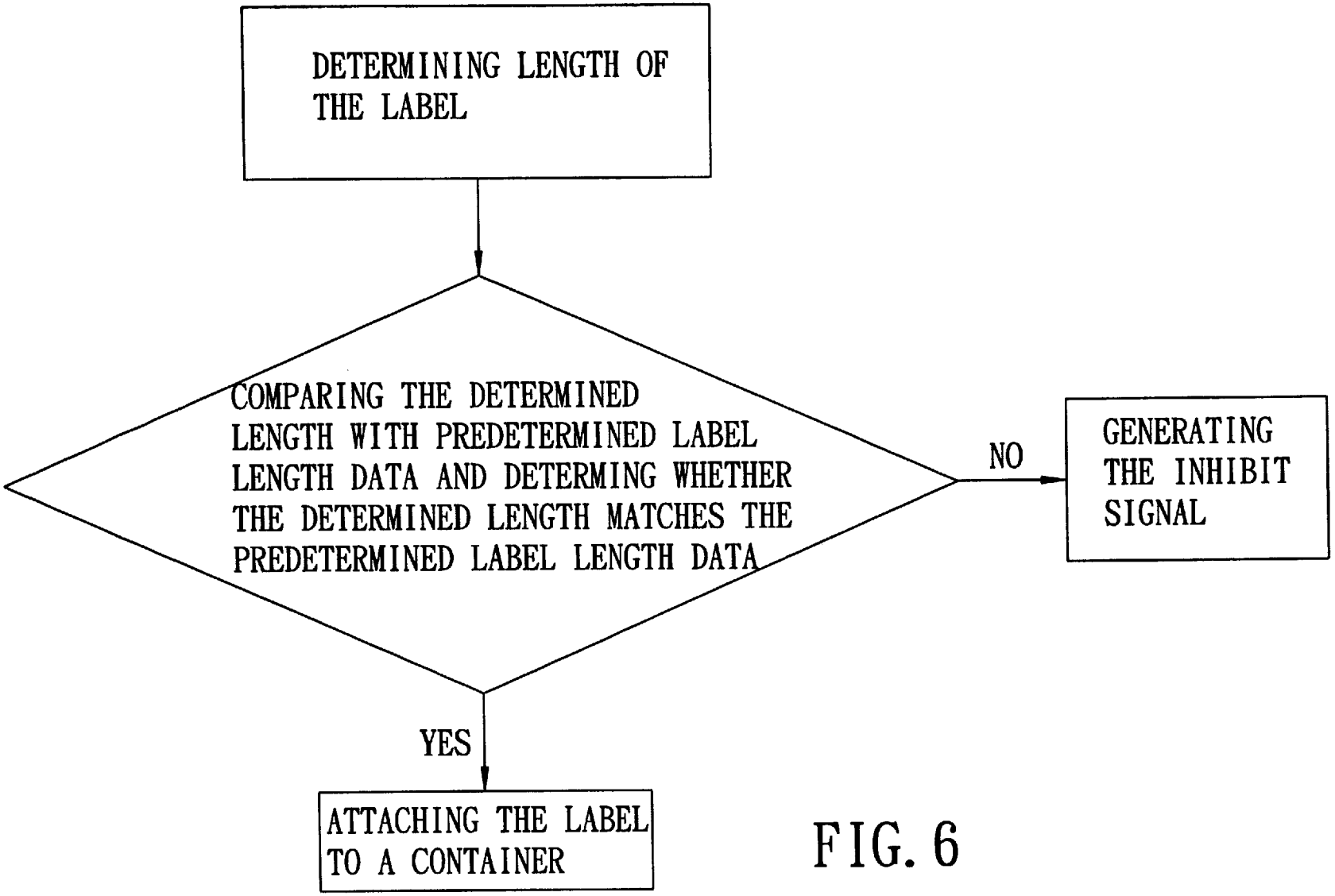
FIG. 6 is a flow chart illustrating a label length inspecting operation of the controller of the preferred embodiment.
Figure 7:
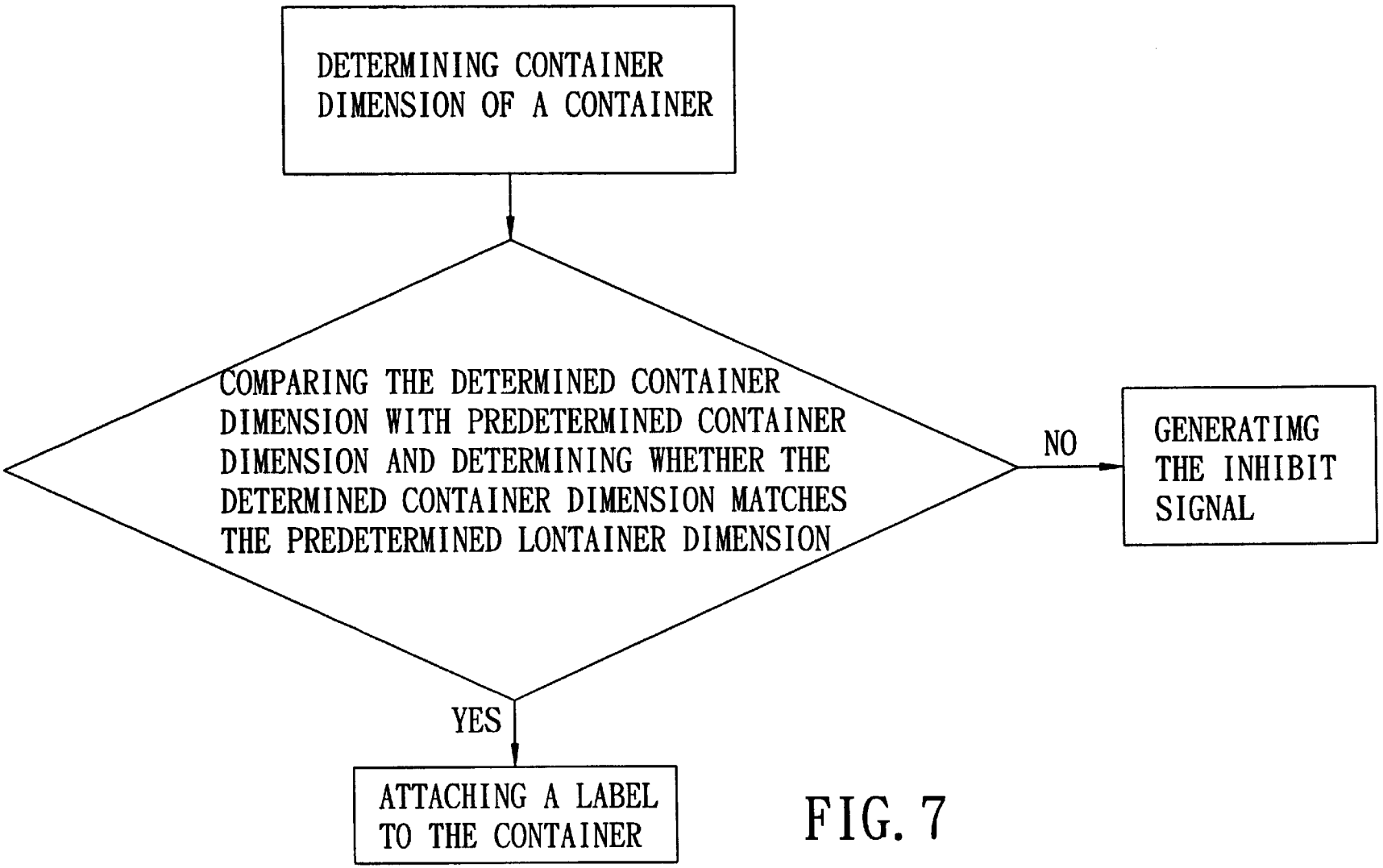
FIG. 7 is a flow chart illustrating a container dimension inspecting operation of the controller of the preferred embodiment.

The controller 40 is coupled electrically to the first and second encoder units 211, 321, the bar code sensor 50, the label sensor 60 and the container sensor 70. As shown in FIG. 5, the controller 40 compares the bar code data from the bar code sensor 50 with predetermined bar code data, and generates an inhibit signal when a mismatch occurs. It is noted that whenever a new bar code is sensed by the bar code sensor 50, new bar code data, which serves as the predetermined bar code data, can be established in a memory device (not shown) of the controller 40. As shown in FIG. 6, the controller 40 determines the length of one of the labels 81 on the label reel 80 in accordance with the first and second signals from the second encoder unit 321, compares the determined length with predetermined label length data, and generates the inhibit signal when a mismatch occurs. It is noted that whenever a new label length is sensed by the label sensor 60, new label length data, which serves as the predetermined label length data, can be established in the memory device of the controller 40. As shown in FIG. 7, the controller 40 determines container dimension, such as a width of the container 90 being conveyed by the conveying unit 20, in accordance with the container feature information from the container sensor 70 and the first distance information from the first encoder unit 211, compares the determined container dimension with predetermined container dimension, and generates the inhibit signal when a mismatch occurs. It is noted that whenever a new container is sensed by the container sensor 70, new container dimension, which serves as the predetermined container dimension, can be established in the memory device of the controller 40. The controller 40 is further coupled electrically to the conveying unit 20 and the label applying unit 30. The inhibit signal is issued to stop operation of the conveying unit 20 and the label applying unit 30.

The alarm unit 41 is coupled electrically to the controller 40, and is activated to generate an alarm output upon reception of the inhibit signal from the controller 40.

It can be appreciated from the aforesaid that whenever there is a mismatch of the bar code data, the label length data or the container dimension, the labeling machine of this invention can generate the alarm output and stop operation of the conveying unit 20 and the label applying unit 30. As such, this invention is capable of preventing erroneous attachment of the labels 81 on the containers 90. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A labeling machine, comprising:

a motor-driven container conveying unit having a feed-in end and a take-out end, said conveying unit being adapted to convey a container from said feed-in end to said take-out end;

a label applying unit disposed adjacent to said conveying unit between said feed-in and take-out ends, and operable so as to be adapted to attach a label on the container being conveyed by said conveying unit, said label applying unit including a reel support plate adapted to support a label reel thereon, the label reel including a backing paper strip and a plurality of the labels releasably and successively adhered on the backing paper strip, each of the labels having a bar code printed thereon, a label applicator plate adapted to release one of the labels from the backing paper strip at a label releasing end thereof for application to the container being conveyed by said conveying unit, and a motor-driven guide roller unit disposed between said reel support plate and said label applicator plate and operable so as to feed one end of the label reel on said reel support plate to said label applicator plate;

a first encoder unit associated with said conveying unit and operable so as to generate first distance information to indicate distance advanced by the container due to operation of said conveying unit;

a second encoder unit associated with said guide roller unit and operable so as to generate second distance information to indicate distance advanced by said one end of the label reel during feeding operation of said guide roller unit;

a bar code sensor disposed adjacent to said reel support plate, and adapted to sense the bar code on the labels of the label reel and to generate corresponding bar code data;

a label sensor disposed between said reel support plate and said label applicator plate, said label sensor generating a first signal upon detection of a leading edge of one of the labels on the label reel and further generating a second signal upon detection of a trailing edge of said one of the labels on the label reel;

a container sensor disposed adjacent to said conveying unit between said feed-in and take-out ends, said container sensor generating container feature information of the container being conveyed by said conveying unit; and a controller coupled electrically to said first and second encoder units, said bar code sensor, said label sensor and said container sensor;

said controller comparing the bar code data from said bar code sensor with predetermined bar code data, and generating an inhibit signal when a mismatch occurs;

said controller determining length of one of the labels on the label reel in accordance with the first and second signals from said label sensor and the second distance information from said second encoder unit, comparing the determined length with predetermined label length data, and generating the inhibit signal when a mismatch occurs;

said controller determining container dimension of the container being conveyed by said conveying unit in accordance with the container feature information from said container sensor and the first distance information from said first encoder unit, comparing the determined container dimension with predetermined container dimension, and generating the inhibit signal when a mismatch occurs.

2. The labeling machine of claim 1, wherein said controller is further coupled electrically to said conveying unit and said label applying unit, and the inhibit signal is issued to stop operation of said conveying unit and said label applying unit.

3. The labeling machine of claim 1, further comprising an alarm unit coupled electrically to said controller, and activated to generate an alarm output upon reception of the inhibit signal from said controller.

4. The labeling machine of claim 1, wherein the container feature information includes a first signal generated by said container sensor upon detection of a leading edge of the container being conveyed by said conveying unit, and a second signal generated by said container sensor upon detection of a trailing edge of the container being conveyed by said conveying unit.

5. The labeling machine of claim 4, wherein the container dimension determined by said controller is a width of the container being conveyed by said conveying unit.

* * * * *